United States Patent [19]

Shaw

[11] 4,332,144

[45] Jun. 1, 1982

[54] BOTTOMING CYCLE REFRIGERANT SCAVENGING FOR POSITIVE DISPLACEMENT COMPRESSOR, REFRIGERATION AND HEAT PUMP SYSTEMS

[76] Inventor: David N. Shaw, 33 Silversmith Rd., Unionville, Conn. 06085

[21] Appl. No.: 247,968

[22] Filed: Mar. 26, 1981

[51] Int. Cl.[3] ..... F25B 13/00

[52] U.S. Cl. ..... 62/324.1; 62/238.1; 62/235.1; 62/512; 62/513; 62/505

[58] Field of Search ..... 62/324.1, 324.4, 324.5, 62/238.1, 235.1, 174, 503, 509, 512, 513

[56] References Cited

U.S. PATENT DOCUMENTS

| | | | |
|---|---|---|---|
| 1,786,791 | 12/1930 | Terry | 62/196 |
| 2,123,498 | 7/1938 | Buchanan | 62/510 |
| 2,555,005 | 4/1951 | Warneke | 62/196 |
| 2,990,698 | 7/1961 | Crotser | 62/503 |
| 3,082,610 | 3/1963 | Marlo | 62/509 X |
| 3,246,482 | 4/1966 | Harnish | 62/174 X |
| 3,264,840 | 8/1966 | Harnish | 62/324.1 |
| 3,307,368 | 3/1967 | Harnish | 62/324.1 |
| 4,006,602 | 2/1977 | Fanberg | 62/505 X |
| 4,134,274 | 1/1979 | Johnsen | 62/238.1 X |

OTHER PUBLICATIONS

Mechanical Refrigeration by N. R. Sparks, Chapter 8, Theory of Multiple Effect Vapor Compression, pp. 111 to 127.

*Primary Examiner*—Lloyd L. King
*Attorney, Agent, or Firm*—Sughrue, Mion, Zinn, Macpeak and Seas

[57] ABSTRACT

Scavenging is applied to a conventional refrigeration cycle to return most of the energy normally remaining in a warm condensed liquid to the cycle. This permits considerably more energy to be picked up in the evaporator of the cycle than under conventional practice. The concept is applicable to any type positive displacement compressor where an intake of evaporator generated gas can be trapped in the compressor, with the scavenged gas then added prior to mechanical compression. The concept is particularly applicable to reciprocating compressor type heat pump systems.

11 Claims, 8 Drawing Figures

FIG. 1
PRIOR ART
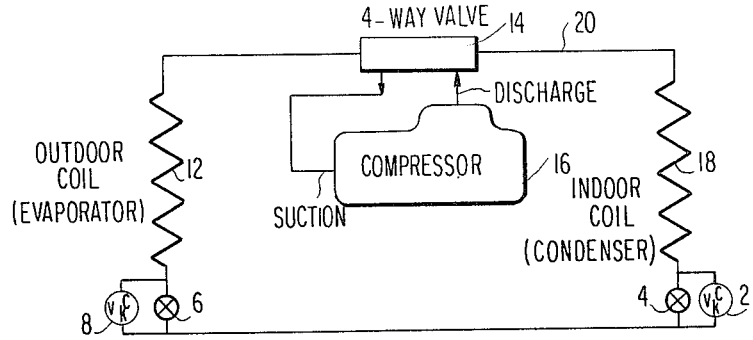
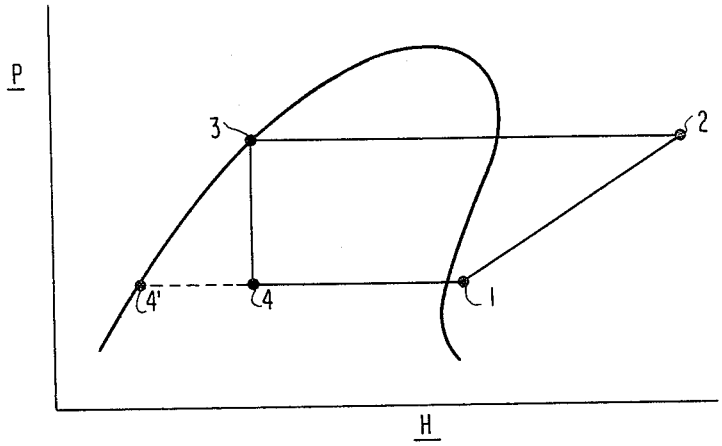
FIG. 2
PRIOR ART
TYPICAL PRESSURE ENTHALPY DIAGRAM
FIG. 3
PRIOR ART
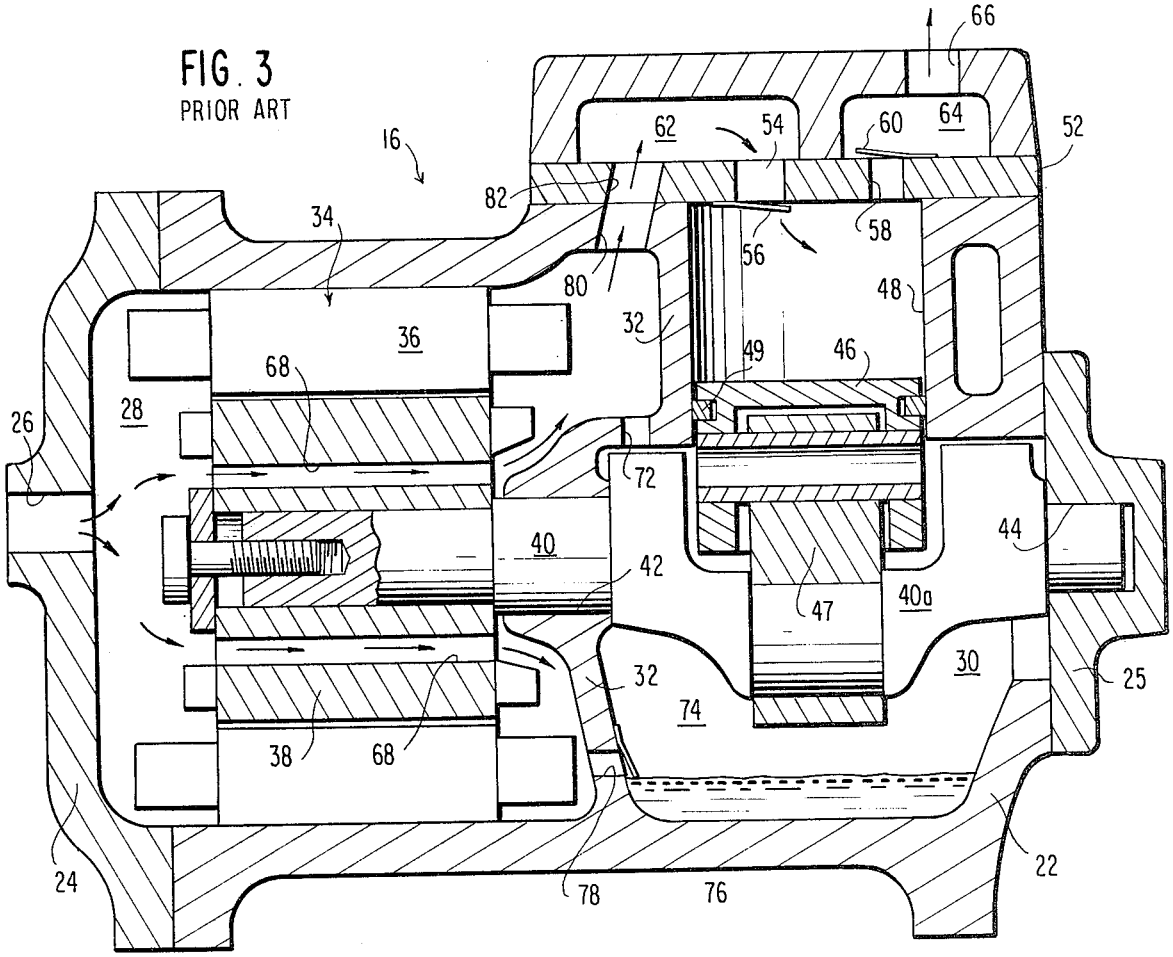

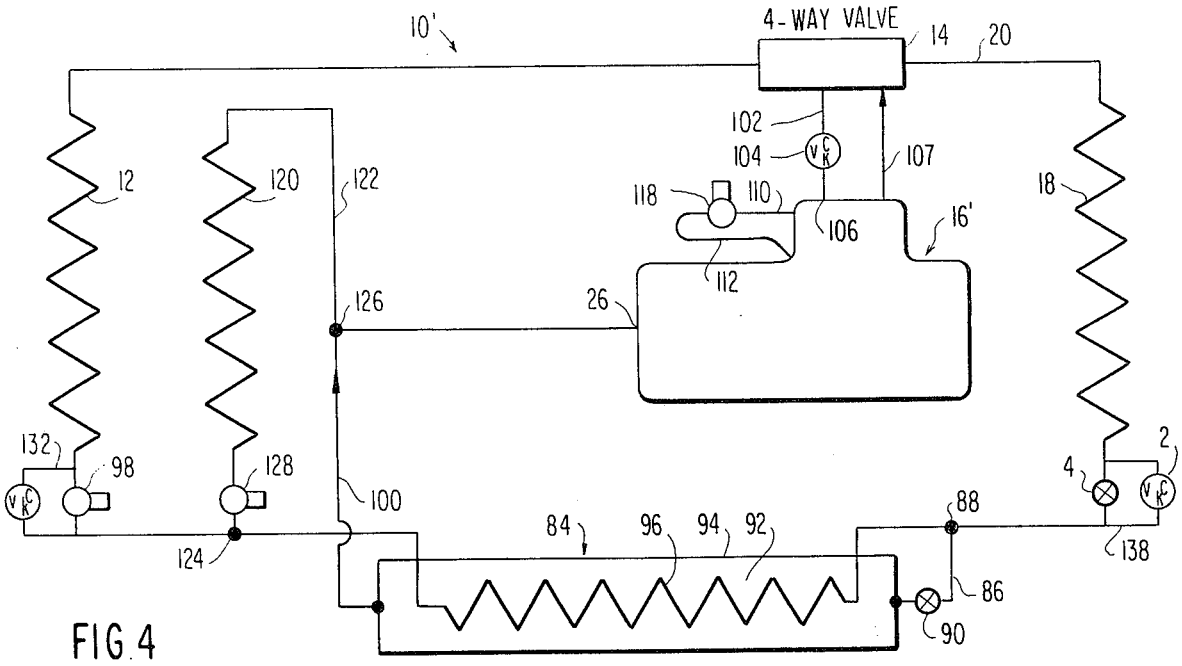
FIG. 4
FIG. 5
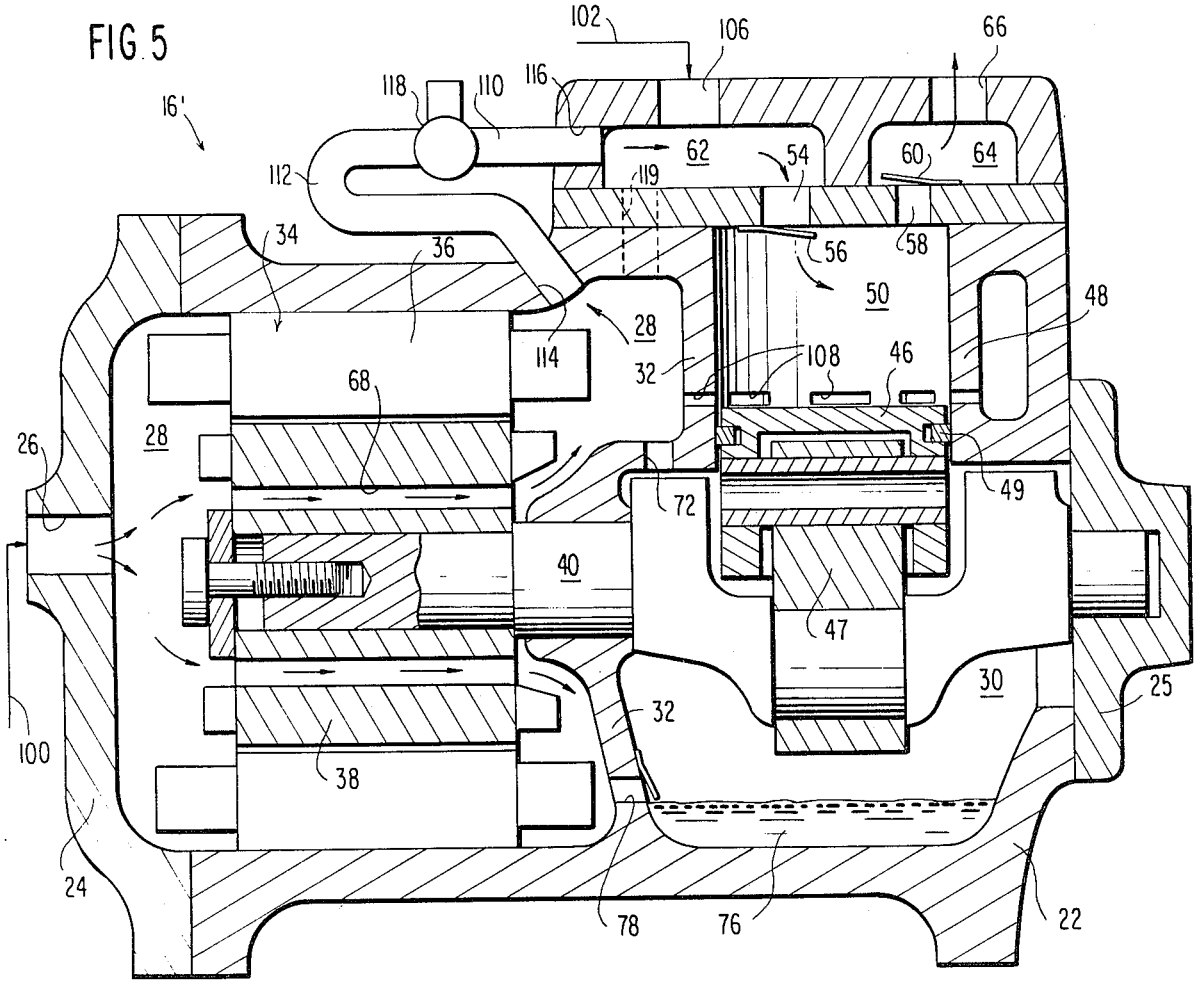

TYPICAL PRESSURE VOLUME DIAGRAM

TYPICAL PRESSURE ENTHALPY DIAGRAM

BOTTOMING CYCLE REFRIGERANT SCAVENGING FOR POSITIVE DISPLACEMENT COMPRESSOR, REFRIGERATION AND HEAT PUMP SYSTEMS

BACKGROUND OF THE INVENTION

Present day refrigeration, air conditioning, and heat pump systems are generally quite simple in nature, especially in the smaller sizes, and deal with a very simple refrigeration cycle. In this relatively conventional, simple cycle, high pressure refrigerant vapor is condensed in a system condenser resulting in a relatively warm liquid refrigerant. This relatively warm liquid refrigerant is then ducted to an expansion device wherein the pressure is reduced to the evaporating level of the system. In the process of this pressure reduction, the sensible energy present in the liquid is used to evaporate a portion of this same liquid immediately prior to entering the evaporator. The liquid leaving the condenser is normally close to what is called the saturated liquid state. As the pressure is reduced on this saturated liquid, boiling will commence. In order to sustain the boiling process, energy is required. The energy comes from the liquid itself during the normal expansion process. In a typical cycle, a considerable amount of refrigerant vapor is generated during this normal expansion process. Since this refrigerant vapor has already evaporated, it is obvious that it can pick up no more energy through additional evaporation. Only the remaining liquid (after expansion) can be evaporated, thus picking up energy from a source which in turn is cooled. The vapor generated during the expansion process must be inducted into the compressor and compressed back up to the condensing level in order to repeat the cycle. It is obvious that this vapor, so generated, must require a certain portion of the compressor displacement and thus, it prevents that portion of the compressor displacement from taking in vapor that was indeed generated by the source evaporating the remaining liquid after expansion. While this particularly wasteful process has not caused too much concern, especially in the smaller sized air conditioning cycles, it has been most wasteful in the higher compression ratio refrigeration cycles. It is one of the primary reasons for very serious capacity deterioration in air source heat pumps when operating at the lower ambients, and it has been recognized and dealt with in the larger two stage air conditioning cycles.

In the larger two stage refrigeration systems, a device known as a flash gas economizer is commonly used. In this system, the warm condensed liquid is reduced in pressure to that level corresponding with the inlet pressure of the second stage compressor. In the process of doing this, a significant portion of the energy present in the warm condensed liquid is, therefore, removed prior to this liquid undergoing the final stage of expansion immediately preceding the evaporator. This has made an improvement in the performance of these larger air conditioning systems generally ranging between 5 to 10%, depending upon the compression ratio or lifts encountered. In other words, the increase in evaporator capacity is greater than the increase in system power requirements with the performance being defined as the ratio of evaporator energy divided by compression energy requirement.

DESCRIPTION OF THE PRIOR ART

A typical prior art heat pump refrigeration system 10 is shown in FIG. 1, in which an outdoor coil 12, four way valve 14, compressor 16 and indoor coil 18 form the major components of a closed loop refrigeration system or cycle series connected by conduit means, indicated generally at 20. The compressor 16 as shown can be any type of positive displacement machine. During the heating mode, energy is picked up in the outdoor coil 12, functioning as an evaporator, increased in thermal level by the compressor 16, and transferred by the indoor coil 18 (condenser) to that medium which is to be heated. The typical refrigeration cycle involved is shown in FIG. 2. The refrigerant vapor carried by the conduit means 20 in the closed loop cycle, enters the compressor 16, FIG. 2, at point 1 and leaves at point 2 after compression. The warm vapor is directed to the condenser 18, and liquid leaves the condenser at point 3 via check valve 2, bypassing expansion device 4, is expanded by a constant enthalpy process to point 4 at expansion device 6, bypassing check valve 8, passes through the evaporator 12 and returns to point 1 for re-introduction to the compressor in the compression process. After this expansion process (point 4 to point 1), it can be seen from the diagram that the energy content (per unit of mass) picked up in the evaporator, i.e. outdoor coil 12, is that existing between points 4 and 1. Where the liquid entering the evaporator is saturated or close to being saturated, the energy content (per unit of mass) picked up in the evaporator 12 would be considerably greater. This is shown in FIG. 2 as the difference between point 4' and point 1. It is obvious that if one were to pick up this increase in energy per unit of mass, with no increase in compressor displacement required, this would be a major advantage in air source heat pumps, refrigeration cycles, or high lift air conditioning cycles. Effectively, the pick up would involve at least the energy represented by the dotted line from 4' to 4.

For the typical prior art refrigeration, air conditioning or heat pump system, (as described in FIGS. 1 and 2), a typical reciprocating compressor may be utilized within the system, FIG. 3. The hermetic reciprocating compressor indicated generally at 16 comprises a compressor central housing or casing 22 of generally cylindrical form bearing end bells or end walls 24 to the left and 25 to the right, respectively as shown, the end bells being bolted to the ends of the compressor cylindrical housing or casing section 22 by bolts (not shown). Within left end wall 24, there is provided a suction gas inlet opening 26 which opens to a first chamber 28, separated from a second chamber 30, to the right, by a casing vertical wall structure indicated at 32. Chamber 28 houses a hermetic electrical motor indicated generally at 34 comprised of stator 36 and rotor 38. A shaft 40 has fixedly mounted thereto the motor rotor 38, the shaft 40 being supported by a journal bearing 42 within vertical wall 32 and a journal bearing 44 within end wall 25. Shaft 50 includes intermediate walls 32, 25, a compressor crankshaft portion 40*a*, rotatably supporting a crank arm 47 to which is mounted a piston 46 for reciprocation within cylinder 48, in conventional reciprocating compressor fashion. The piston 46 bears rings at 49 sealing off the compression chamber 50 as defined by cylinder 48, piston 46 and a cylinder head 52. The cylinder head 52 is provided with a suction port 54 closed off to compressor chamber 50 by a spring type, suction flap valve 56. It is further provided with a discharge or outlet port 58 closed off to the compressor chamber by a discharge flap valve 60. The cylinder head 52 is further comprised of a suction passage 62 and a discharge passage 64, the discharge passage 64 opening to the exterior of the compressor by way of a casing discharge port 66. The piston reciprocates between a top dead center position and the bottom dead center position, shown in FIG. 3.

As may be appreciated, suction gas is employed as low side cooling for the hermetic motor 34, the rotor 38 bearing a plurality of longitudinal holes or passages 68, permitting the cooling gas to pass through the rotor 38 and discharge against the wall 32. A vent hole 72 permits the suction gas to enter a crank case portion 74 of chamber 30 which crankcase bears within the bottom thereof oil as at 76 for compressor lubrication purposes. An oil return hole 78 is provided within the casing vertical wall 32 which opens back to the chamber 28 bearing hermetic motor 34.

After cooling the hermetic motor 34, the suction gas is permitted to pass through aligned holes 80, within the hermetic casing 22, and 82 within the cylinder head 52. It enters into the suction passage 62 leading to the compression chamber 50, as defined by the piston 46, cylinder 48 and cylinder head 52, via the cylinder head suction or inlet port 54, past suction flap valve 56.

As may be appreciated, the crank case pressure within crank case 74 is equalized to the level of the low side of the system by way of the vent or passage 72.

While this compressor permits low side cooling and achieves the introduction of the suction gas into the compressor chamber 50 after passage over the hermetic motor for cooling the same, there are substantial disadvantages as described previously.

It is, therefore, an object of the present invention to provide an improved refrigeration system or heat pump system which includes a positive displacement compressor and in which most of the energy normally remaining in the warm condensed liquid within the refrigeration cycle is scavenged and returned to the cycle and to the compressor compression chamber during termination of the system evaporator suction return to that compression chamber and prior to mechanical compression.

It is a further object of the present invention to provide an improved positive displacement compression compressor refrigeration or heat pump system in which such scavenged refrigerant vapor is passed over a hermetic drive motor for the compressor for cooling the motor prior to scavenging entry into the compression cycle of the compressor itself.

It is a further object of the present invention to provide such an improved refrigeration or heat pump system incorporating a positive displacement compressor, wherein unloading of the compressor is effected by permiting selective merging of system scavenge gas with the suction gas during the compressor intake stroke.

SUMMARY OF THE INVENTION

The present invention is directed, in part to a closed loop refrigeration or heat pump system including first and second coils which may comprise indoor and outdoor coils, respectively, a positive displacement compressor, conduit means bearing a refrigerant and forming a closed loop refrigeration cycle and connecting the first and second coils and the compressor in closed loop series. A reversing valve may be employed for selectively causing the first and second coils to trade functions as system condenser and evaporator for the closed loop system. Expansion means is provided upstream of the coil functioning as system evaporator. The improvement resides in the system comprising a scavenge vapor generator downstream of the coil functioning as the condenser and upstream of the coil functioning as the evaporator for recovery of heat from the hot liquid refrigerant passing from the condenser to the evaporator by vaporization of a portion of the liquid refrigerant bled from the closed loop. The compressor includes means for selective delivery of scavenged refrigerant vapor from the scavenged vapor generator at a pressure higher than the system suction pressure to the compressor working chamber at the end of compressor working chamber suction intake from the system evaporator and low side. Unloading means may be provided for selectively returning scavenged vapor to the compressor suction inlet for entry commonly with the suction gas returning from the coil functioning as the system evaporator during the whole compressor intake portion of the cycle.

Preferably, the compressor is of the hermetic type including an electrical drive motor, and the system further comprises means for directing the scavenged refrigerant vapor from the scavenged vapor generator over the motor prior to entering the compressor working chamber. The positive displacement compressor may comprise a reciprocating compressor including at least one cylinder, a reciprocating piston mounted within the cylinder and operatively coupled to the hermetic motor, a cylinder head overlying the cylinder and including valved inlet and outlet ports leading to and from the compression chamber defined by the cylinder, the cylinder head and the reciprocating piston. The compressor further includes a scavenge gas inlet chamber surrounding the cylinder and isolated from the cylinder head, scavenge ports within the cylinder near the bottom dead center position of the piston relative to its reciprocating stroke within the cylinder, and opening to the scavenged gas inlet chamber whereby the scavenge ports are uncovered as the piston approaches bottom dead center to permit scavenged gas entry into the working compression chamber. The scavenge ports are closed off shortly after the piston starts to move from bottom dead center towards top dead center during the compression stroke of the compression cycle. The compressor further comprises unloading means in the form of a closed unload passage leading from the scavenge gas chamber to the cylinder head inlet passage, and wherein the unload passage includes valve means for selectively controlling the flow of scavenge gas to the suction passage of the cylinder head, thereby selectively permitting scavenge gas and suction gas from the scavenge vapor generator and said coil functioning as the system evaporator to return to the compression chamber, during the full suction stroke of the piston and throughout the extent of travel of the piston from top dead center to bottom dead center.

BRIEF DESCRIPTION OF THE DRAWINGS

FIG. 1 is a schematic diagram of a typical prior art air source heat pump refrigeration system.

FIG. 2 is a typical pressure enthalpy plot diagram of the system of FIG. 1, under heating mode.

FIG. 3 is a vertical sectional view of a typical prior art positive displacement reciprocating compressor forming an element of the heat pump system of FIG. 1.

FIG. 4 is a schematic diagram of the improved heat pump system forming a preferred embodiment of the present invention.

FIG. 5 is a vertical sectional view of an improved scavenging and unloading, positive displacement reciprocating compressor forming an aspect of the present invention and employed in the heat pump system illustrated in FIG. 4.

DESCRIPTION OF PREFERRED EMBODIMENTS

Figure 6:
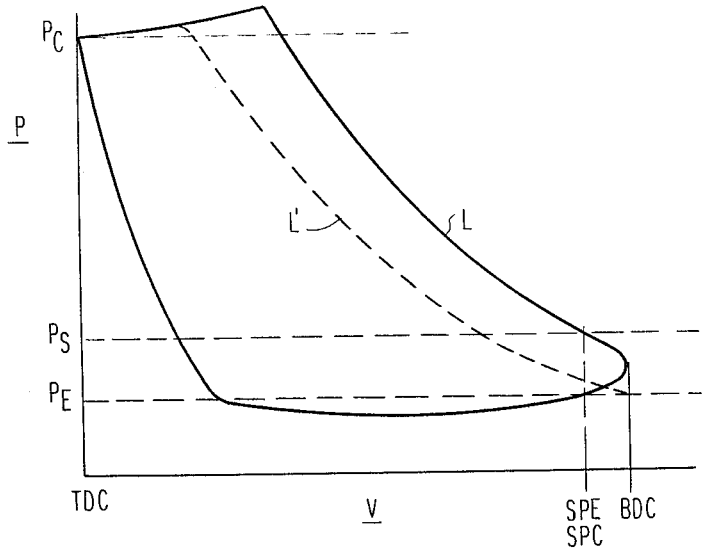
FIG. 6 is a pressure volume diagram for the reciprocating compressor of FIG. 5 as employed in the heat pump system illustrated in FIG. 4.

One embodiment of the present invention is applied to a heat pump environment wherein elements identical to those appearing within the prior art as described in conjunction with FIGS. 1–3 inclusive, carry like numerical designations. In that respect, this illustrated embodiment of the invention as per FIG. 4, is directed to a closed loop refrigeration system using a typical refrigerant such as R-12, R-22 or the like, and within the environment of a heat pump, that is, in a reversible refrigeration or heat pump system 10′ where the outdoor coil 12 trades condenser and evaporator functions with the indoor coil 18 within the closed loop system. A modified compressor 16′ is connected a via four way valve 14 in a closed refrigeration loop defined by conduit means 20.

The heat pump system 10′ is characterized by the utilization of a scavenge vapor generator or recovery heat exchanger indicated generally at 84. Additionally, the compressor 16′ differs materially from that of compressor 16 of the prior art system. By way of modification of the compressor and the inclusion of the scavenger vapor generator 84, a desirable advantage is achieved within the closed loop refrigeration system, as discussed previously. The vapor scavenge vapor generator/recovery heat exchanger 84 functions to remove almost all of the energy from warm condensed refrigerant liquid discharging from the indoor coil 18 acting as the condenser for the system when the heat pump is operating under heating mode or within the heating cycle, prior to that liquid refrigerant entering the outdoor coil 12 functioning as system evaporator. This heat removal is accomplished by means of a bleed line 86 connected at point 88 to conduit means 20, downstream of the indoor coil 18 and upstream of the outdoor coil or evaporator 12. From bleed point 88, line 86 leads through an expansion valve or capillary means as at 90 to the interior 92 of the scavenge vapor generator casing 94 and functions to remove heat from liquid refrigerant passing through coil 96 of the scavenge vapor generator 84, through which the major portion of the liquid refrigerant passes within conduit means 20, leading to the outdoor coil 12.

This heat removal is accomplished by evaporating a portion of the condensed liquid refrigerant and taking the refrigerant vapor or gas thus generated within casing 94 during evaporation or scavenging and injecting this scavenge vapor into the compressor 16′ after the normal suction process by the reciprocating compressor piston is nearly completed, that is, near termination of the suction process or stroke. In doing so, there is an increase in system capacity because the energy picked up in the system evaporator (outdoor coil 12) is increased, due to the fact that there is a removal or scavenge of substantial portion of the energy from the warm liquid refrigerant before it enters the system evaporator via the solenoid expansion valve 98 within line 20 leading to the outdoor coil 12.

The manner in which this is accomplished may be further appreciated by reference to the modified reciprocating compressor 16′, FIG. 5, forming part of the heat pump system 10′.

In that respect, instead of connecting the system evaporator suction or vapor return line to the casing opening 26 leading to the interior of the hermetic reciprocating screw compressor, the outlet of the system evaporator (outdoor coil 12) connects directly to the suction passage within compressor cylinder head 52.

The opening or hole 26 within end wall 24 leading to the hermetic motor scavenge gas inlet chamber 28, FIG. 5, is connected to by way of a recovery charge line 100 to the outlet side of the scavenge vapor generator housing 94, to thereby channel the scavenge vapor directly to the chamber 28 housing the hermetic motor for cooling of the hermetic motor in this manner, rather than through the use of the suction gas emanating from the coil functioning as the system evaporator. The closed loop conduit 20 connects to the compressor 16′ via four way valve 14 and a suction line 102, FIG. 4. Suction line 102 bearing a check valve 104 upstream of a compressor casing suction or inlet port 106 opening to the cylinder head suction passage 62. Suction valve 56 opens head suction port 54 to allow the suction gas to enter the compression chamber 50 via suction port 54 until the piston 46 nears bottom dead center position. At that time, scavenge ports 108, which open radially within cylinder 48, to the scavenge gas inlet chamber 28 are uncovered to permit the scavenge gas which is at a pressure above that of the suction gas emanating from the outdoor coil 12 (or other coil functioning as the evaporator) to enter compression chamber 50. As may be readily appreciated, since the pressure within chamber 50 is in excess of the pressure within the suction passage 62 of cylinder head 52, the higher pressure scavenge refrigerant vapor or gas enters the interior of the compression chamber 50, preventing further intake of suction gas from the outlet side of the outdoor coil 12.

The compressor and the system are further characterized by an unloading passage indicated generally at 110 which is formed by a conduit 112 which opens at one end, through a drilled hole 114 within casing 22, directly into scavenge gas inlet chamber 28, while its opposite end opens to the suction passage 62 via a hole 116 within the side of cylinder head 52. Conduit 112 holds an unloading solenoid valve or throttling valve 118 to permit, during unload mode, some of the higher pressure scavenge gas to mix with the system low side suction gas returning from the outdoor coil 12 (or other coil functioning as the system evaporator). Both gas returns are simultaneously drawn into the compression chamber 50 upon movement of the piston 46 from top dead center towards bottom dead center position, with valve 118 open.

The unload solenoid valve or throttle valve 118 may be either an on/off valve or a modulation valve. Using a modulating valve causes a variable flow rate to the scavenge gas passing through the unload passage 110 into the suction passage 62 of the cylinder head 52. Further, while the conduit 112 is shown as bearing the unloading solenoid valve 118 exterior of the compressor, it may be possible to provide the unloading passage extending wholly internally within the hermetic compressor 16', that is, within casing 22 and cylinder head 52, directly into passage 62, as by way of radial holes through these two elements, as indicated in dotted lines at 19.

If the unloading valve 118, FIG. 5, is considered closed for illustration purposes, the suction gas enters the cylinder from coil 12 via conduit means 20, 4-way valve 14, suction line 102, casing suction or inlet port 106, suction passage 62 and cylinder head inlet or suction port 56, to the compression chamber 50. Suction gas continues to enter the cylinder and thus compression chamber 50 as the piston 46 moves downwardly in its stroke until the piston uncovers scavenge ports 108. At that point, the pressure level in the cylinder exceeds the suction pressure and suction flap valve 56 closes off the suction or inlet port 54 to chamber 50. However, the scavenge gas from the scavenge vapor generator 84 continues to enter the cylinder through the scavenge ports 108 until a new cylinder or compression chamber pressure is developed, considerably higher than suction pressure at suction passage 62. Obviously, the source of this higher pressure is the energy removed by the scavenge vapor generator/recovery heat exchanger 84. Depending upon the conditions of operation and the refrigerant utilized, the absolute cylinder pressure upon completion of scavenging, can be as high as double the absolute suction pressure level as seen within suction passage 62. As an example, this doubling would occur if R-502 were utilized as the refrigerant, and the system involves an air source heat pump operating at 0° F. outdoor ambient condition for outdoor coil 12, FIG. 4, and condensing at approximately 115° F. for indoor heating purposes. Obviously at much lower system temperature lifts (or compression ratios), the increase in cylinder pressure at 50 due to waste heat scavenging is much less. However, in air source heat pump systems, as exemplified in FIG. 4, the scavenging is the greatest when it is most needed. It is also seen that the identical scavenging process is applicable to refrigeration systems in general, as it is to heat pump systems (a reversible refrigeration system) in that the capacity of the refrigeration system is greatly enhanced when operation is effected with the scavenging system of the present invention.

What is most necessary in air source heat pump systems is the ability to deliver enough heat when it is cold outside. This can be done with conventional systems only through the addition of a supplementary heat source of some type such as electrical resistance heating, use of a gas, oil or other fuel burner, etc. It is also seen that a dramatic increase in conventional compressor displacement would suffice for this purpose. Some manufacturers have attempted to achieve this end by utilization of two speed or twin compressors where both are operational at the lower ambient or where higher speed is utilized at the lower ambient in order to supply the necessary heating capacity.

Valve 118 may be an on/off control as shown, or a stepped or modulating control to vary the loading or capacity of the compressor to meet system needs.

By further reference to FIG. 4, it may be seen that, in addition to the outdoor coil 12 functioning in a heating mode as the system evaporator, there is provided an auxiliary low grade heat source evaporator or coil 120 connected in parallel with the scavenge vapor generator 84 by way of an auxiliary heat source line 122 connecting coil 120, of its inlet into the closed loop system 20 at a point 124 downstream of the scavenge vapor generator 84 and upstream of outdoor coil 12. Further the line 122 connects the outlet side of the auxiliary heat source evaporator 20 to the recovery charge line 100 at point 126 upstream of the opening 26 within end wall 24 leading to chamber 28 forming scavenge inlet chamber and bearing the hermetic motor 34. A suitable expansion device such as a solenoid expansion valve 128 is provided within line 122 on the inlet side of the auxiliary heat source evaporator 120. By such means, an auxiliary or supplementary heat source is added to the heat pump or refrigeration system where such auxiliary or supplementary heat is available. This coil functions as a high temperature evaporator and by energization of the solenoid operated valve 128 this low grade energy is fed into the system. While coil 120 operates in parallel with the scavenged vapor generator 84, the outdoor coil 12 still supplies as much energy as possible during the heating mode for the heat pump system. The supplementary heat source 120 supplies only that energy which the system requires in excess of what it can normally obtain from the outside air. Obviously, the system further increases the cylinder pressure at the point of scavenge port 108 closure above that which would be achieved without the supplementary heat source provided by evaporator 120.

Further, assuming that the auxiiary low grade heat source evaporator 120 is a moderate level solar energy derived source, by unloading the compressor by energization of the unload solenoid valve 118, no further valving is required in employing the auxiliary source provided by coil 120 in lieu of the outdoor source, that is, the outdoor coil 12. This is possible through the utilization of the check valve 104 within the suction line 102 (otherwise the check valve 104 may be eliminated). The check valve 104 opens in the direction of flow from the four way valve to compressor 16' and closes in the reverse direction preventing condensation of auxiliary source generated refrigerant vapor in the outdoor coil 12 during auxiliary source coil 120 operation alone. Further, by the use of the solenoid expansion valve 98 (along with the check valve 8 within line 132 bypassing the solenoid expansion valve) 98, it is possible to close off the liquid refrigerant feed to the outdoor coil 12. As customary, the indoor coil 18 is provided with an expansion valve as at 4 within conduit 20 and a check valve 2 within a bypass line 138, thereabouts to permit the indoor coil and outdoor coil to trade functions as evaporator and condenser for the system, under control of 4 way valve 14.

As may be appreciated, utilizing the system of FIG. 4 with the scavenging reciprocating compressor of FIG. 5, (or equivalent rotary compressor), there is substantially improved positive displacement compression system ability to heat effectively at lower ambient temperatures. For example, if the novel scavenging compressor were combined with an efficient two speed motor 34 while further utilizing the unloading mechanism involving the unloading passage 110 and unloading solenoid valve or equivalent throttling valve as at 118, there is achieved an extremely flexible compression heat pump system capable of operating efficiently over the entire range of heating and cooling conditions normally experienced.

If one merely opens the unloading valve 118 to the cylinder head 52, the hermetic motor 34 would still be cooled by the gas generated by the scavenge vapor generator 84. However, instead of the vapor entering the scavenge ports 108 thereby increasing the pressure level, the vapor is bypassed to the low side of the compressor, i.e. suction passage 62, where the bulk of it enters the working or compression chamber 50 through the suction or intake valve 54, as shown. If one were to assume that with the unloading valve 118 closed, there would be some 1.6 units of mass refrigerant vapor in the compressor cylinder compression chamber 50 at the point of scavenge port closure during movement of the piston 46 from bottom dead center towards top dead center, one can make a comparison to see the effectiveness of the unloader system of the present invention.

In order to have 1.6 units of mass in the cylinder 48 at the point of scavenge port closure, it is assumed for purposes of discussion that the pressure level would have to be 1.6 times the pressure level existing in the system evaporator, i.e. outdoor coil 12. It is obvious that if the unloading valve 118 were opened, the pressure level existing in the cylinder 48 (compression chamber 50) at the point of scavenge port 108 closure, will be essentially that existing in the system evaporator 12. In other words, there would be an increase in the effective pumping capability of the compressor 16' by a factor of 1.6 by loading the compressor (closing the unloader). This factor, again depending upon refrigerant employed and operating conditions, will vary from approximately 1.2 to 2.2 within the range of typical refrigeration and heat pump system operational parameters. It can be seen from FIG. 5, that the crank case oil reservoir area/motor housing area (chamber 30) is all exposed to scavenge pressure via vent passage 72 and oil return passage 78. Were this not the case, when the piston ring 49 has passed over the scavenge ports 108 on its up stroke, scavenge gas would be allowed to leak into the crank case area thus destroying the peak capacity and efficiency of the system. It is obvious to those skilled in the art that alternative means of sealing could be used such as long piston with rings on both ends, etc., in order to avoid the crank case requirement of scavenge pressure level. However, it appears that the simplest arrangement is that shown in FIG. 5, and it is also noted that the hermetic motor 34 is being cooled with vapor generated by the scavenge vapor generator 84. This cooling is indeed better than the prior art arrangement where the hermetic motor is cooled by the vapor generated by the system evaporator as occurs with conventional reciprocating compressors, FIG. 3. It should be noted that the presently available conventional reciprocating compressors suffer serious volumetric efficiency deterioration at higher compression ratio operation due to the way the suction vapor is inducted into the compressor and the various heat exchange paths that are incurred. This particular problem is lessened in severity by the use of scavenge gas from the scavenge vapor generator 84 to cool the hermetic motor 34, as shown, FIG. 5.

The nature of incorporating the hermetic compressor components including the hermetic drive motor 34 within a steel enclosure determined by end bells 24, 25 and generally cylindrical casing 22, is effected otherwise in a manner standard to hermetic reciprocating compressor designs.

The unloading valve 118 may be an on/off valve, or may be of the stepped or continuously modulating type, which later type would be particularly advantageous in refrigeration systems. Were one operating under conditions where the scavenge machine is considered to be generating 100% capacity and the fully unloaded machine considered to be generating 50% capacity, it is apparent that the capacity level between these two values can be readily generated by proper variable restriction of the passage 110, with variable restriction being achieved by a modulating type unload valve. In other words, the cylinder pressure level at the point of scavenge port closure can be anywhere from its maximum down to essentially that pressure corresponding to the evaporating level as defined by the outlet pressure at outdoor coil 12 or other system low pressure evaporator. In this way, there is created a variable capacity refrigeration system which normally operates at an efficiency level higher than that of conventional systems, being reduced to the efficiency level of the conventional system only in the fully unloaded state.

Turning next to FIG. 6, this figure shows a typical pressure volume diagram for the scavenged and unloaded reciprocating compressor 16' within a typical system such as that set forth in FIG. 4. As may be appreciated, compressor suction or intake takes place with the cylinder pressure within compression chamber 50 slightly lower than the evaporator pressure level as defined by coil 12, FIG. 4, as the cylinder volume increases during piston 46 movement downwardly towards its bottom dead center. When the piston reaches the SPE (scavenge port exposure) position, it is obvious that the cylinder pressure will start to increase due to the increased pressure of the scavenge gas entering the interior of the compression chamber 50 via the scavenge ports 108. As the piston starts to move upward on its compression stroke, after reaching bottom dead center, (BDC) the scavenge ports 108 are not closed immediately, thus there is a pressure rise due to further reduction of scavenged gas as well as volume reductin due to piston up motion. It is expected that when the piston reaches the point of scavenge port closure (SPC) FIG. 6, the cylinder pressure will be approximately equal to the scavenge pressure when considering a proper designed port/piston stroke condition. As may be seen in FIG. 5, the ideal configuration for the scavenge ports 108 is one of rectangular configuration and affords the greatest possible area consuming the minimum piston stroke and also giving sufficient piston ring support. The normal range of crank shaft rotation angle for crank shaft 40*a* between initial scavenge port exposure and scavenge port closure is expected to lie between 30° and 70°.

Optimizing studies permit one to determine the ideal relationship between port area/piston stroke, etc. Additionally, FIG. 6 shows that if one were to fully unload the compressor, as evidenced by the dotted line L' illustrating the unloaded condition in comparison to line L illustrating the loaded condition, the cylinder pressure at the time of scavenge port closure will only be slightly above suction pressure due to the fact that any tendency to increase cylinder pressure above suction when the piston is progressing upwardly and the scavenge ports 108 are still exposed, will merely result in gas exiting the scavenge ports 108. When one considers a heat pump system, the mass of refrigerant vapor delivered to the heating condenser, i.e., indoor coil 18 (assuming heating mode), is what is important to the heating effect. As can be seen from FIG. 5, when fully loaded, the mass of gas delivered to the heating condenser 18 is considered greater than the mass of gas delivered when fully loaded. It can also be noted that for all practical purposes, the capacity of any air conditioning, refrigeration, or heat pump cycle conceived herein, is approximately proportional to the mass of vapor entering the system condenser or system evaporator. Thus, whether discussing the heat pump in heating mode or a refrigeration cycle, it is obvious that capacity variation capability is present within the system illustrated to meet the normal needs for both heat pump and refrigeration applications.

Figure 7:
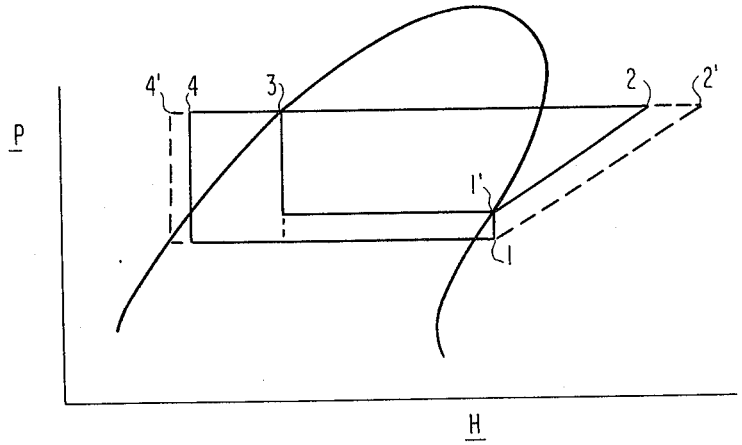
FIG. 7 is a pressure enthalpy diagram for the scavenging and unloading reciprocating positive displacement compressor heat pump system illustrated in FIG. 4.

FIG. 7 shows a typical pressure enthalpy diagram covering the scavenging and unloading reciprocating compressor 16' as applied to a heat pump system illustrated in FIG. 4. As may be seen from the diagram, refrigerant vapor enters the compressor suction port 54 via the past the suction flap valve 56 at point 1. The pressure is increased to the scavenge pressure 1' by essentially a constant enthalpy process. Mechanical compression then takes place from point 1' to point 2 during movement of the piston 46 from the point where it closes off the scavenge ports 108 to top dead center. Warm refrigerant liquid leaves the condenser (indoor coil 18) at point 3 and enters the scavenge vapor generator 84, FIG. 4. Some of the refrigerant liquid is directly expandable via line 86 and expansion valve 90 to cool the remaining liquid on its path through the scavenge vapor generator 84, via coil 96.

The scavenge vapor within the confined volume 92 defined by casing 94 is directed to the compressor via inlet port 26 within end bell 24 through the recovery charge line 100. The balance of the liquid refrigerant within the closed loop conduit 20, is cooled to point 4, FIG. 7, in the scavenge vapor generator 84 coil 96. As may be appreciated, by way of the present invention, there is achieved the type of action desired, as indicated preivously in the discussion of FIG. 2, it may be further noted that some increase in system efficiency is also apparent as the compression energy requirement per pound of refrigerant mass to go from point 1' to point 2, is less than the compression energy requirement per pound of mass to go from point 1 to point 2'. Since the capacity is essentially a function of the amount of mass refrigerant entering the system evaporator, it is apparent that the system efficiency has also been enhanced by this process. Also, when the system is unloaded, the liquid instead of being cooled to point 4, will now be cooled to a further point 4' due to the fact that the pressure level leaving the scavenge vapor generator 84 will be lower (as it is now being essentially bled to the evaporator level of coil 12). This can be further deduced from the fact that the available compressor displacement is used to induct both scavenge gas and evaporator gas when unloaded, whereas the primary compressor displacement is used solely to induct evaporator gas when the compressor is loaded and the unloading solenoid operated valve 118 is closed, preventing the scavenge gas from mixing with the suction gas within suction passage 62 leading to suction port 56 of the cylinder head 52.

As indicated previously, supplemental or auxiliary heat may be added to the cycle or system by the mere energization of a solenoid valve to supply refrigerant vapor in parallel with the vapor generated within the scavenge vapor generator 84 in removing the thermal energy from the hot liquid refrigerant passing to the outdoor coil 12 or other coil functioning as the system evaporator. Solenoid valve 128 permits the induction of low grade energy into the system by feeding the vaporized refrigerant through line 122 to point 126 intersecting the recovery charge line 100 leading from the scavenge vapor generator 84 to inlet port 26 opening to the hermetic compressor interior.

Figure 8:
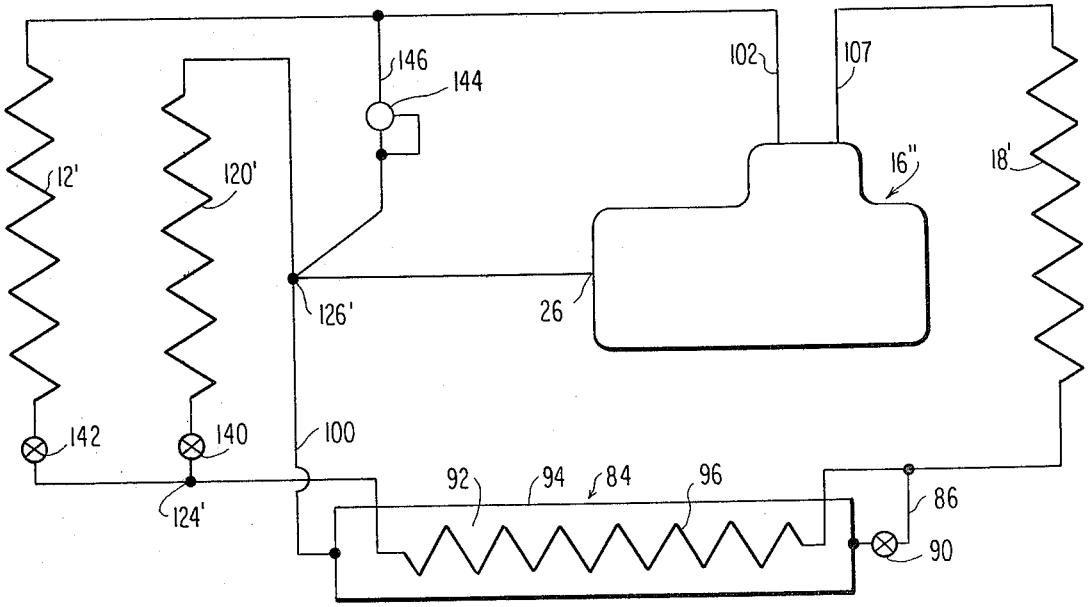
FIG. 8 is a schematic diagram of a two coil refrigeration system forming a further embodiment of the present invention.

Referring next to FIG. 8, the improved scavenging compressor system is shown as applied to a typical two coil refrigeration system, forming an alternate embodiment of the invention. Again, like components bear like numerical designations. In that respect, the four way valve is eliminated and the compressor 16'' which is similar in most respects to that shown in FIG. 5, has its discharge line 106 connected directly to a coil 18' functioning as the system condenser. The output of coil 18' passes to the scavenge vapor generator 84. A major portion of the hot liquid refrigerant passes through that unit via coil 96, and a portion is bled into bleed line 86k, where by way of an expansion valve 90 (or capillary tube) the pressure is reduced with the refrigerant vaporizing within the interior 92 of casing 94 of the scavenge vapor generator, thereby picking up much of the available thermal energy from the liquid refrigerant prior to its passage to the two refrigeration coils 12' and 120' corresponding, respectively, in position but not function to the outdoor coil 12 and the auxiliary low grade heat source coil 120 of the embodiment of FIG. 4. Again, a recovery charge line 100 connects the volume 92 or interior of casing 94 to a modified compressor 16'', the scavenge gas entering the compressor via the hole or passage 26 within end bell 24 of the compressor 16''. In this embodiment, a simple capillary may be provided as at 140 within the line 122' connecting the higher temperature refrigeration coil 120' into the system with the higher pressure refrigerant vapor flowing to the hermetic compressor 16'' and passing to the interior of the compressor for cooling the hermetic motor 34 along with the scavenge vapor within recovery charge line 100 emanating from unit 84. The other evaporator coil 12' comprises the low temperature low pressure coil, i.e. a freezer coil for the refrigerator/freezer unit. A second capillary 142 is provided upstream of coil 12' in conventional fashion, permitting reduction in pressure of the liquid refrigerant and expansion within the freezer coil. The outlet end of the freezer coil 12' is connected directly to compressor 16'' via suction line 102, leading to suction port 106 of the cylinder head 52. There is no check valve within suction line 102 in the manner of the embodiment of FIG. 4. However, there is provided a capacity balance valve, as at 144 within a line 146 which connects, at one end to the suction line 102 between the low pressure, low temperature freezer coil 12' and the compressor 16'' and which line 146 connects at its other end, to point 126' within recovery charge line 100 upstream of opening 26 of hermetic compressor 16'' to which line 100 connects.

The capacity balance valve permits some of the high pressure refrigerant within line 122' bearing high temperature evaporator coil 120' to flow toward the suction line 102, balancing the level between coil 120' and 12'. Balance valve 144 may be set as desired. Normally, a thermostat at the high temperatures refrigeration coil 120 controls compressor ON-OFF operation for entry into the compressor via suction or inlet ports 106 and 54.

As must be further appreciated, in this embodiment the compressor 16" does not have an unloading passage 110 between chamber 70 and the inlet passage 62 within cylinder head 52, nor an unloading solenoid valve as at 118. The loop or conduit 112 is eliminated, and this portion of the hermetic compressor takes a form (similar to prior art compressor 16) such that chamber 28 is cut off from the compression chamber 50 other than by way of uncovering scavenge ports 108 when the piston moves towards bottom dead center during its down stroke which opens chamber 28 momentarily to the interior of the cylinder, i.e. the compression chamber 50.

While the invention has been particularly shown and described with reference to a preferred embodiment thereof, it will be understood by those skilled in the art that various changes in form and details may be made therein without departing from the spirit and scope of the invention.

What is claimed is:

1. A closed loop refrigeration system comprising:

first and second coils, a positive displacement compressor having a compressor working chamber, conduit means bearing a refrigerant and forming a refrigeration cycle closed loop and connecting said first and second coils and said compressor in closed loop series, said first and second coils functioning as condenser and evaporator for said closed loop system, expansion means provided upstream of the coil functioning as system evaporator, the improvement comprising:

a scavenge vapor generator within said closed loop, downstream of the coil functioning as the condenser and upstream of the coil functioning as the evaporator for recovery of heat from the hot liquid refrigerant passing from the condenser to the evaporator and including means for vaporizing a portion of said warm liquid refrigerant bled from the closed loop in heat exchange with the remaining portion of said liquid refrigerant passing to said evaporator, means for selective delivery of scavenge refrigerant vapor from the scavenge vapor generator to said working chamber at the end of the compressor working chamber intake at a pressure higher than the suction pressure of the compressor working chamber, and unloading means for selectively returning scavenged vapor to the compressor suction inlet for entry commonly with the suction gas returning from the coil functioning as the system evaporator during full compressor intake.

2. The system as claimed in claim 1, wherein said positive displacement compressor comprises a reciprocating compressor including at least one cylinder, a piston mounted for reciprocation within said cylinder and being operatively coupled to a hermetic motor, a cylinder head overlying said cylinder and including valved inlet and outlet ports leading to and from said compressor working chamber defined by said cylinder, said cylinder head and said reciprocating piston, and said selective delivery means comprises a scavenge gas inlet chamber surrounding said cylinder and being isolated from said cylinder head and scavenge ports carried by said cylinder adjacent a bottom dead center position of said piston during its reciprocating stroke within said cylinder and opening to said scavenge gas inlet chamber; whereby, the scavenge ports are uncovered as said piston approaches bottom dead center to permit scavenge gas entry into the compressor working chamber, said scavenge ports are closed off shortly after said piston starts to move from bottom dead center towards top dead center during the compression portion of the cycle, and wherein said unloading means includes valve means for controlling the flow of scavenge gas to said suction passage of said cylinder head, thereby permitting intermediate pressure scavenge gas from said scavenge vapor generator and low pressure refrigerant vapor from said coil functioning as the system evaporator to return to the compressor working chamber during the full suction stroke of said piston throughout the extent of travel of said piston from top dead center to bottom dead center.

3. The system as claimed in claim 2, further comprising means for venting said scavenge gas chamber to the compressor crank case.

4. The system as claimed in claim 2, wherein said unload valve comprises a solenoid valve.

5. The system as claimed in claim 2, wherein said unload valve comprises a modulating valve for incrementally varying the flow rate of scavenge gas from said scavenge gas chamber to said suction passage of said cylinder head.

6. The system as claimed in claim 2, wherein said first and second coils comprise, respectively, an indoor coil and an outdoor coil for a heat pump system, and said system further comprises a reversing valve interposed between said compressor and said indoor and outdoor coils for selectively, reversibly directing refrigerant from said compressor to one of said coils functioning as the system condenser and for returning vaporized refrigerant from the other coil functioning as the system evaporator to said compressor, a suction line connecting said four way valve to said suction passage of said compressor, and a discharge line connecting said discharge passage of said compressor to said four way valve, a check valve within said suction line for preventing refrigerant flow from said suction passage to said four way valve, said system further comprising an auxiliary low grade heat source coil connected within said closed loop in parallel with said scavenge vapor generator and downstream of said scavenge vapor generator, and wherein said conduit means comprises means for connecting the outlet of said auxiliary low grade heat source coil to said scavenge gas chamber of said compressor, such that commonly, the scavenged gas from the scavenger vapor generator and refrigerant vapor from said auxiliary low grade heat source evaporator is returned to the compressor scavenge chamber at a pressure higher than that of the coil functioning as the system evaporator supplying suction gas directly to the suction gas passage of said cylinder head.

7. A closed loop refrigeration system comprising:

first, second and third coils, a positive displacement compressor having a compressor working chamber, conduit means bearing a refrigerant and forming a refrigeration cycle closed loop and connecting said first and second coils and said compressor in closed loop series, said first coil functioning as a condenser and connected to the outlet of said compressor, said second coil functioning as an evaporator and connected between said condenser and said compressor, expansion means provided upstream of said second coil, the improvement comprising:

a scavenge vapor generator within said closed loop, downstream of said first coil and upstream of said second coil, means for bleeding a portion of warm liquid refrigerant from said closed loop downstream of said first coil and upstream of said second coil for vaporization within said scavenge vapor generator in heat exchange with the remaining portion of said liquid refrigerant passing to said evaporator for the recovery of heat from that portion of the hot liquid refrigerant passing from the condenser to the evaporator, said system further including means for selective delivery of scavenge refrigerant vapor from said scavenge vapor generator at a pressure higher than the suction pressure of said compressor working chamber to said compressor working chamber at the end of the compressor working chamber intake, means for connecting said third coil in parallel with said scavenge vapor generator and upstream of said second coil within said closed loop and with the discharge from said third coil being connected to said means for selective delivery of scavenge refrigerant vapor from said scavenge vapor generator to said working chamber at the end of said compressor working chamber intake, and means upstream of said third coil for expansion of liquid refrigerant into said third coil, said third coil functioning as a high pressure, high temperature evaporator coil and said second coil functioning as a low temperature, low pressure evaporator coil, and wherein said system further comprises a capacity balance line connected between the outlet of said third coil and the outlet of said second coil, including a capacity balance valve for controlling the flow of refrigerant from the outlet side of said third coil to said conduit means connecting the outlet of said second coil to the suction side of said comprssor.

8. The system as claimed in claim 7, wherein said positive displacement compressor comprises a hermetic compressor including a hermetic electrical drive motor, and said system further comprises means for directing scavenge refrigerant vapor from said scavenge vapor generator and said third coil over said motor prior to entering the compressor working chamber.

9. The system as claimed in claim 8, wherein said positive displacement compressor comprises a reciprocating compressor including at least one cylinder, a piston mounted for reciprocation within said cylinder and operatively coupled to said hermetic motor, a cylinder head overlying said cylinder and including valved inlet and outlet ports leading to and from said compressor working chamber defined by said cylinder, said cylinder head and said reciprocating piston, a scavenge gas inlet chamber open to said kinetic drive motor and surrounding said cylinder and being isolated from said cylinder head, scavenge ports carried by said cylinder and opening to the scavenge gas inlet chamber adjacent a bottom dead center position of said piston during its reciprocating stroke within said cylinder; whereby, the scavenge ports being uncovered as said piston approaches bottom dead center to permit scavenge gas entry into the compressor working chamber, and said scavenge ports being closed off shortly after said piston starts to move from bottom dead center towards top dead center durng the compression portion of the cycle, and wherein said capacity balance valve permits a portion of the intermediate pressure scavenge gas from the scavenge vapor generator and high pressure refrigerant from said third coil functioning as the system high pressure, high temperature evaporator to return to the compressor working chamber during the full suction stroke of the piston throughout its extended travel from top dead center to bottom dead center.

10. The system as claimed in claim 9, further comprising means for venting said scavenge gas chamber to the compressor crank case.

11. The closed loop refrigeration system as claimed in claim 1, wherein said positive displacement compressor comprises a hermetic compressor including a hermetic electrical drive motor, and said system further comprises means for directing said scavenge vapor from said scavenge vapor generator over said motor prior to entering the compressor working chamber.

* * * * *